United States Patent [19]

Schwarz

[11] Patent Number: 5,036,645

[45] Date of Patent: Aug. 6, 1991

[54] METHOD OF MAKING A RECLOSEABLE PACKAGE

[75] Inventor: Dean E. Schwarz, Madison, Wis.

[73] Assignee: Oscar Mayer Foods Corporation, Madison, Wis.

[21] Appl. No.: 475,109

[22] Filed: Feb. 5, 1990

[51] Int. Cl.[5] ..... B65B 61/18; B65D 33/16; B31B 1/90

[52] U.S. Cl. ..... 53/412; 53/433; 156/66; 206/632; 383/61; 426/121; 426/123; 426/124; 493/214

[58] Field of Search ..... 53/128, 133, 175, 410, 53/412, 427, 433, 449, 450, 476, 477, 479, 480, 550, 553; 156/66; 206/632; 383/61, 63; 493/213, 214; 426/121, 123, 124, 129, 130

[56] References Cited

U.S. PATENT DOCUMENTS

| | | | |
|---|---|---|---|
| 3,172,443 | 2/1962 | Ausnit . | |
| 3,228,168 | 1/1965 | Grindrod et al. | 53/427 |
| 3,325,084 | 10/1965 | Ausnit . | |
| 3,371,848 | 5/1968 | Ward et al. . | |
| 3,698,979 | 10/1972 | Gifford et al. | 53/477 |
| 3,703,384 | 11/1972 | Seiferth et al. | 53/133 X |
| 4,240,241 | 12/1980 | Sanborn, Jr. | 53/412 |
| 4,246,288 | 1/1981 | Sanborn . | |
| 4,437,293 | 3/1984 | Sanborn, Jr. | 53/433 X |
| 4,528,224 | 7/1985 | Ausnit . | |
| 4,532,652 | 7/1985 | Herrington . | |
| 4,691,373 | 1/1987 | Ausnit . | |
| 4,706,297 | 11/1987 | Ausnit . | |
| 4,782,951 | 11/1988 | Griesbach et al. | 206/632 X |
| 4,817,188 | 3/1989 | Van Erden . | |

*Primary Examiner*—Robert L. Spruill
*Assistant Examiner*—Beth Bianca
*Attorney, Agent, or Firm*—Lockwood, Alex, FitzGibbon & Cummings

[57] ABSTRACT

A flexible recloseable package wherein the enclosed product is supported on a rigid backing board and the package includes a recloseable seal strip mounted on an access edge of the backing board. Two sheets of packaging film surround the backing board and the packaged product. The film is sealed to opposite surfaces of the recloseable seal strip and is further sealed hermetically around the periphery of the backing board.

8 Claims, 3 Drawing Sheets

METHOD OF MAKING A RECLOSEABLE PACKAGE

BACKGROUND AND SUMMARY OF THE INVENTION

The present invention relates generally to recloseable packages for hermetically sealing consumable products supported on a backing board between generally opposing package side panels, and more particularly to recloseable packages for food products and the like in which the recloseable seal is attached to the backing board and the opposing package side panels.

Certain processed meats and/or food products sold to consumers are solo in packages in which the processed meats or food products are mounted on a backing board. The freshness of these food products such as bacon, sliced luncheon meats, cheeses and the like contained within these packages depends upon the extent to which the package is vacuum packed or gas flushed and subsequently hermetically sealed. Often, the purchaser does not use the food products contained within such packages at once, but rather uses them over an extended period of time. When the initial hermetic seal of the package has been breached during opening of the package, a portion or portions of the package are often removed. In such instances, the package cannot be effectively resealed in a manner to preserve the freshness of the food products stored within. The purchaser must often repack the food products in a different suitably recloseable container. Accordingly, a need exists for an improved food product package of the backing board type which has a recloseable seal.

The improved packages of the present invention provide significant advantages in that the hermetic seal extends around the entire periphery of the product so that the package is liquid tight and suitably retains within the package, fluids of the products contained therein, including water, juices, oils and the like, while the package recloseable seal is adhered to the product backing board so that the package can be opened and closed repeatedly to remove portions of the package contents without destroying the integrity of the package. A "zipper" seal consisting of interengaging components such as rib and groove fastener elements is the preferred recloseable seal means.

The hermetic seal disposed around the periphery of the product backing board has an easy open or peel seal portion located peripherally adjacent to the recloseable seal. The peel seal is opened with digital pull-apart forces which are also used to open the recloseable seal. The peripheral hermetic seal can maintain a vacuum, pressurized and/or gas-flushed environment within the package. The peel seal area of the hermetic seal will be formed by effecting a face-to-face seal between two plies of plastic film exterior of the periphery of the product backing board with the strength of the seal permitting separation without destruction or tearing of either ply.

The recloseable seal of the package of this invention is attached to an access edge of the product backing board as well as the opposing package panels. One of the recloseable seal interengaging fastener elements is adhered directly to the backing board while both of the interengaging fastener elements are further adhered to the package panels along opposing sealing surfaces or flanges. In this regard, the two interengaging fastener elements are firmly anchored to both the backing board and the package film, which decreases the possibility that the packaging material may tear or separate when the hermetic seal is opened.

Accordingly, it is a general object of the present invention to provide an improved recloseable package for use with products positioned on a backing board which has a first recloseable seal disposed proximate to the product and a second hermetic peel seal peripherally adjacent to the recloseable seal.

Another object of the present invention is to provide a recloseable package for food products and the like having a recloseable seal disposed near an opening of the package and attached to the product backing board and a hermetic seal peripherally adjacent the backing board, the hermetic seal having a peelable seal area peripherally adjacent the recloseable seal.

Yet another object of the present invention is to provide an improved product package having a peel seal and a recloseable seal, wherein the recloseable seal elements are attached to an inner product supporting bacon board and to the outer plastic packaging film sheets.

These and other objects of the present invention will become more readily apparent from a reading of the following detailed description.

DETAILED DESCRIPTION OF THE INVENTION

Figure 1:
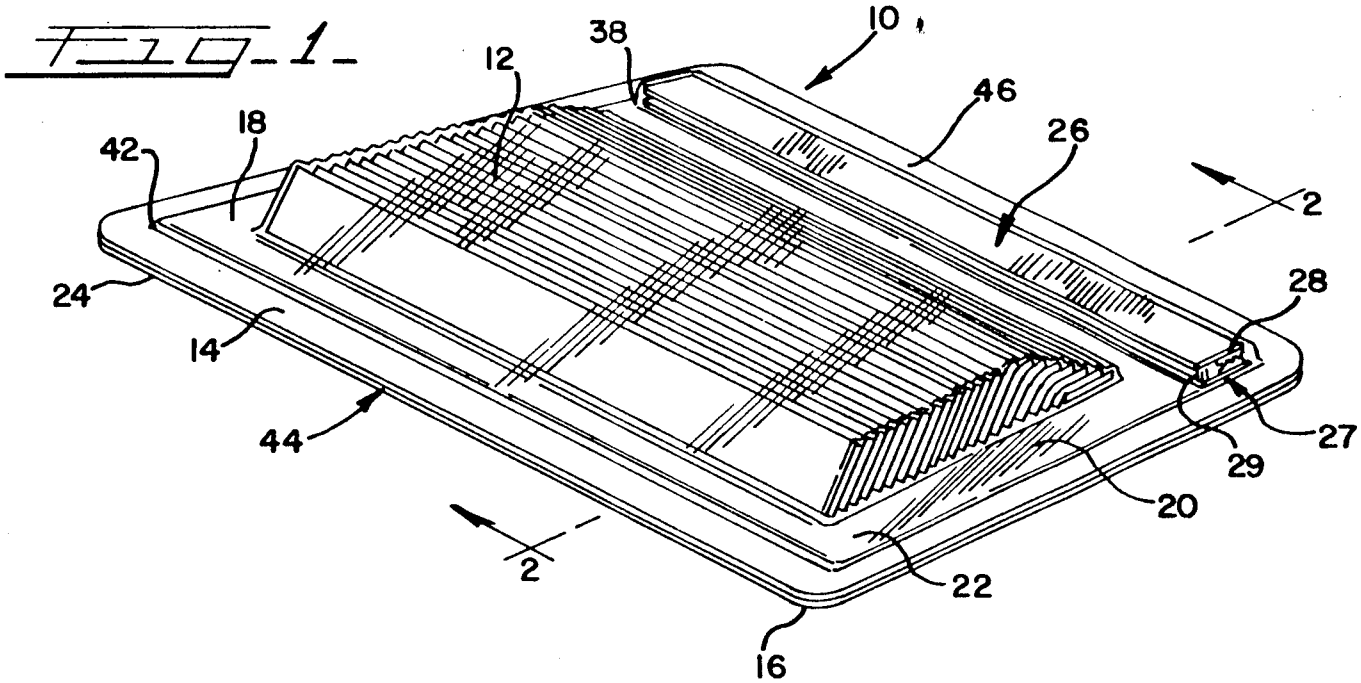
FIG. 1 is a perspective view of a package incorporating the principles of the present invention. For purposes of illustration only, the package is shown as containing vacuum-packed bacon slices.

FIG. 1 illustrates one embodiment of a recloseable package 10 constructed in accordance with the principles of the present invention. The packages 10 of the present invention are particularly suitable for sealing a perishable food product, shown in FIGS. 1 and 2 as bacon slices 12, between two sheets or panels 14, 16 of flexible packaging film material. The first and second film sheets 14 and 16 forming the package 10 can be made from a variety of materials including plastic films, multi-layered laminates or co-extrusions, thermoformable materials and the like. A preferred plastic film for assembly of the packages 10 of the present invention is one which is impervious to air, oxygen or moisture.

When the package film sheets 14, 16 are formed from a laminated construction, it is desirable to use a thin, inner layer which is impervious to air, oxygen or moisture in combination with an outer layer having sufficient flexibility and desirable structural characteristics so that the laminate can function as a package sidewall. For purposes of illustration and discussion, each film sheet will be shown as a single heat-sealable lamina. In actual practice, each film sheet will likely be a laminate of two or more layers which will provide sufficient protection to the product (e.g., oxygen and moisture barriers) and which can form a hermetic, and if desired, peelable seal at thin inner surfaces. As is known in the art, a surface either of vinylidene chloride polymer plastic films, such as "Saran" or of polyvinyl chloride in contact with a surface of an ethylene vinyl acetate plastic film, can form such desired bonds.

Figure 2:
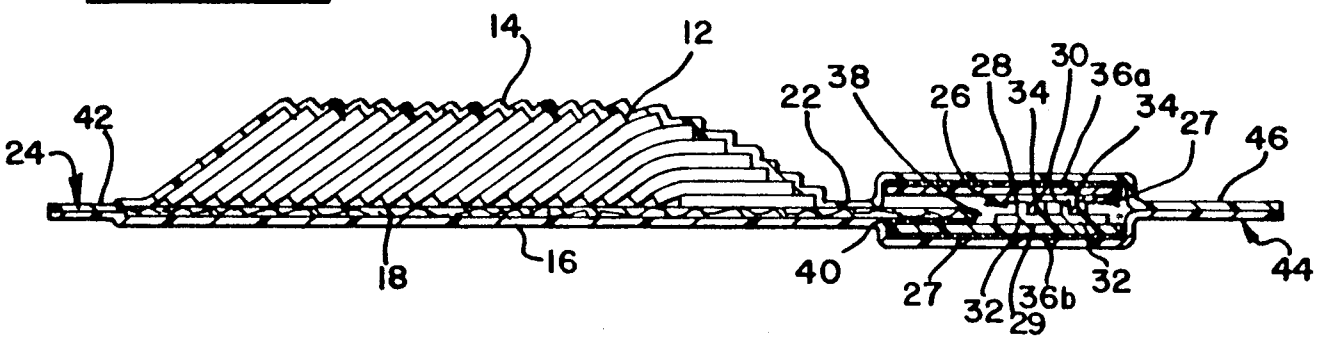
FIG. 2 is a cross-sectional view taken along line 2—2 of FIG. 1.

FIGS. 1 and 2 illustrate a package 10 formed from a first film sheet 14 and a second film sheet 16 which cooperatively enclose a plurality of bacon slices 12 positioned on a generally rectangular, and substantially rigid product backing board 18, sometimes referred to as "bacon" boards. The backing board 18 is preferably constructed from a waxed cardboard having sufficient rigidity to provide a support surface 20 for the bacon, although it will be noted that a thermoplastic sheet can also be used. The bacon slices 12 or the like are desirably positioned on the backing board 18 to provide a first peripheral margin 22 surrounding the bacon 12. The first and second film sheets 14, 16 are combined by contacting each other around the bacon 12 and the backing board 18 to form a continuous edge seal 24 extending around the periphery of the backing board 18. When vacuum-packed, the first and second film sheets 14, 16 are drawn inwardly about the shingled bacon or the like to conform to the contour thereof to provide the package 10 with improved rigidity for withstanding rigorous handling during transport and retail display and the like.

As best shown in FIG. 2, the package has a first recloseable seal 26 illustrated as a conventional interengaging fastener assembly 27 such as a rib and groove fastener assembly. Although the interengaging fastener assembly 27 is illustrated in FIGS. 1 and 2 as one that is particularly secure for the illustrated type of package 10, namely having a length of a formed double rib element strip 28 and a similar length of a formed double groove strip 29. It will be noted that the interengaging fastener elements 28 and 29 of the recloseable seal 26 are not limited to any particular number of interengaging fastener elements. The ribs 30 project outwardly from the double rib element strip 28 a sufficient distance to be securely interengaged with and held by their confronting and complementary counterparts in the double groove element strip 29. The double groove element strip 29 shown includes four outwardly extending walls 32 which define two channels or grooves 34 therebetween. The grooves 34 are of sufficient width to firmly engage the ribs 30 when the confronting interengaging fastener strips 28, 29 are pressed together. Both the recloseable seal 26 and the interengaging fastener assembly 27 can take any number of various characteristics and configurations in addition to those described herein.

In an important aspect of the present invention, the rear surfaces of the interengaging fastener elements 28, 29 include film sealing surfaces flanges **36*a*, 36*b* which extend transversely to the fastener elements 28, 29 and which provide surfaces to adhere and seal the first and second film sheets 14, 16 to the recloseable seal 26. As shown in FIG. 2, the sealing flanges 36*a*, 36*b* can be separate members which are formed apart from the rib and groove elements and subsequently attached thereto by any suitable means such as heat sealing or adhesive sealing. Alternatively, the flanges 36*a*, 36*b* can be integrally formed with their respective fastener elements 28, 29. At least one sealing flange 36*b* of the interengaging fastener elements 28, 29 is sufficiently wide so that a portion of the sealing flange 36*b* is provided with a longitudinal surface 40 disposed on the flange 36*b* adjacent to the backing board 18. The interengaging fastener assembly 27 is attached to the backing board 18 by adhering the fastener element flange longitudinal surface 40 to the bacon board access edge 38. This may be accomplished by any appropriate means such as a suitable adhesive or, in instances where the backing board 18 is a thermoplastic material, the fastener assembly 27 may be adhered to the bacon board by heat sealing or the like. The interengaging fastener assembly 27 is preferably of the same length as the backing board 18 so that the fastener material is not wasted in the trimming of the package 10 and so that it does not interfere with the peripheral hermetic seal 44** of the package.

After the fitting of the interengaging fastener assembly 27 to the backing board 18, the product 12 is positioned on the backing board 18 to form a product board assembly. That product board assembly is placed between the first and second film sheets 14, 16. The first and second film sheets are adhered to the recloseable seal 26 along the longitudinal sealing flanges **36*a*, 36*b* thereof, by heat sealing, by sealing with an adhesive, or by any other suitable means. Any air present between the first and second film sheets 14, 16 when the product 12 is inserted can be evacuated and/or the product 12** gas-flushed if desired.

The first and second film sheets 14, 16 are preferably dimensioned somewhat larger than the bacon board 18 to provide a second peripheral margin 42 where the first and second film sheets contact each other and which extends around the periphery of the product board assembly. The first and second film sheets 14, 16 are bonded together to form a hermetic seal 44 which encircles the package 10 in the second margin 42. This bonding can be effected in any conventional manner, such as by heat sealing or by adhesives. It will be noted that because the recloseable fastener assembly 27 does not extend substantially past the edges of the backing board 18 into the second margin 42, it will not interfere with the effectiveness of the hermetic seal 44. As best seen in FIG. 2, it is desirable to make a portion of the hermetic seal 44 which is peripherally adjacent the recloseable seal 26 a peelable seal 46 to allow the purchaser simple and easy access to the recloseable seal 26. The hermetic seal 44 may be entirely of a peelable nature with the hermetic seal portion thereof having a stronger bond effected between the two films than in the peelable portion 46 so that the hermetic seal 44, for all intents and purposes, is non-peelable. After bonding the two films together, the hermetic seal 44 and the package second margin 42 can be trimmed to appropriate dimensions.

Figure 3:
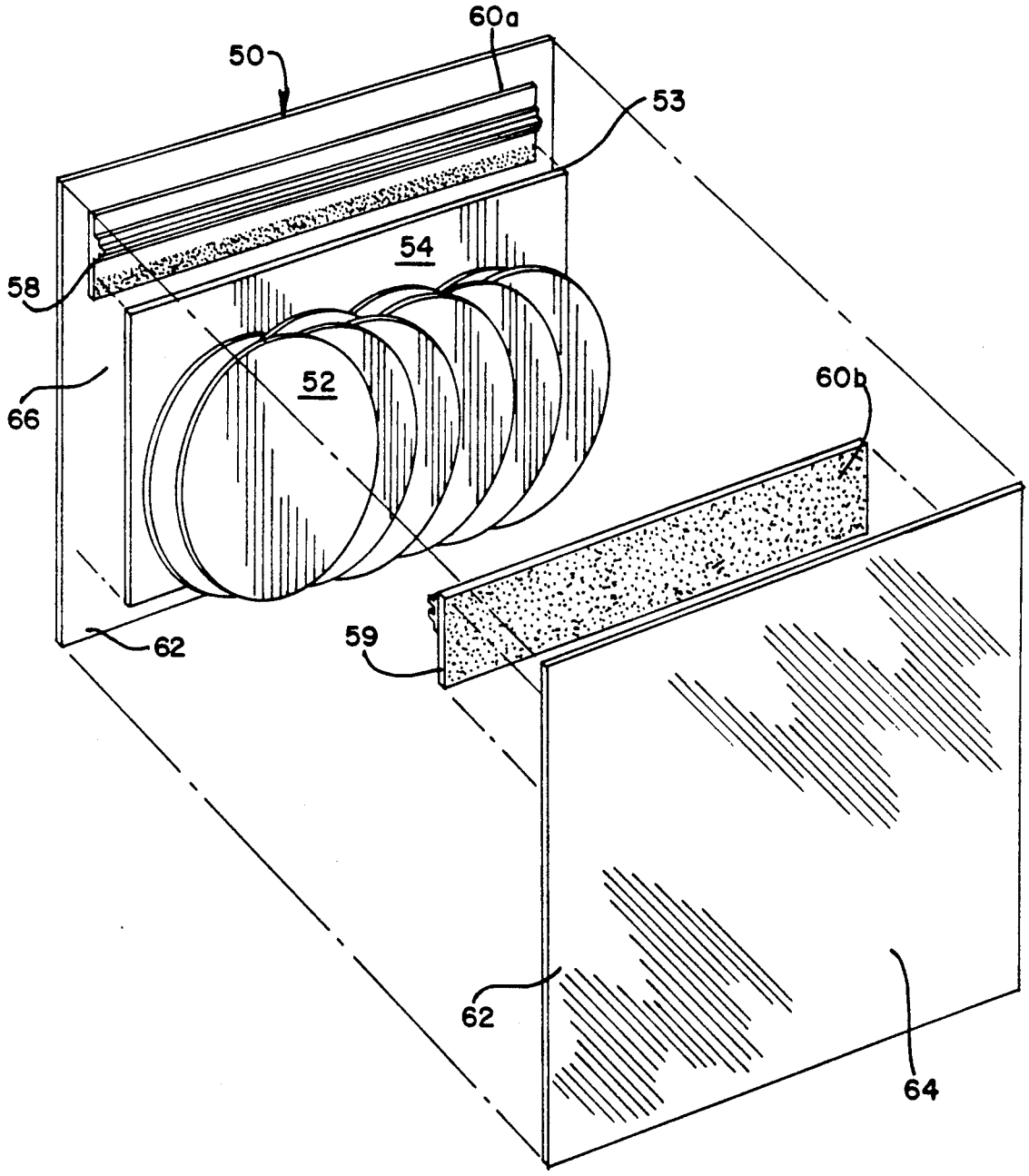
FIG. 3 is an exploded perspective view of another embodiment of a recloseable package. For purposes of illustration only, the package is shown as containing luncheon meats.

Another embodiment of a recloseable package 50 incorporating the principles of the present invention is shown in FIG. 3. The basic construction of this embodiment is generally the same as that described in the embodiment illustrated in FIGS. 1 and 2. However, in this embodiment, the product contained in the package 50 is a plurality of luncheon meat slices 52, and the interengaging fastener elements 58, 59 have only single rib and groove elements 58, 59. Additionally, each interengaging fastener element 58, 59 has its respective film sealing flange **60*a*, 60*b*** integrally formed therewith.

Figure 4:
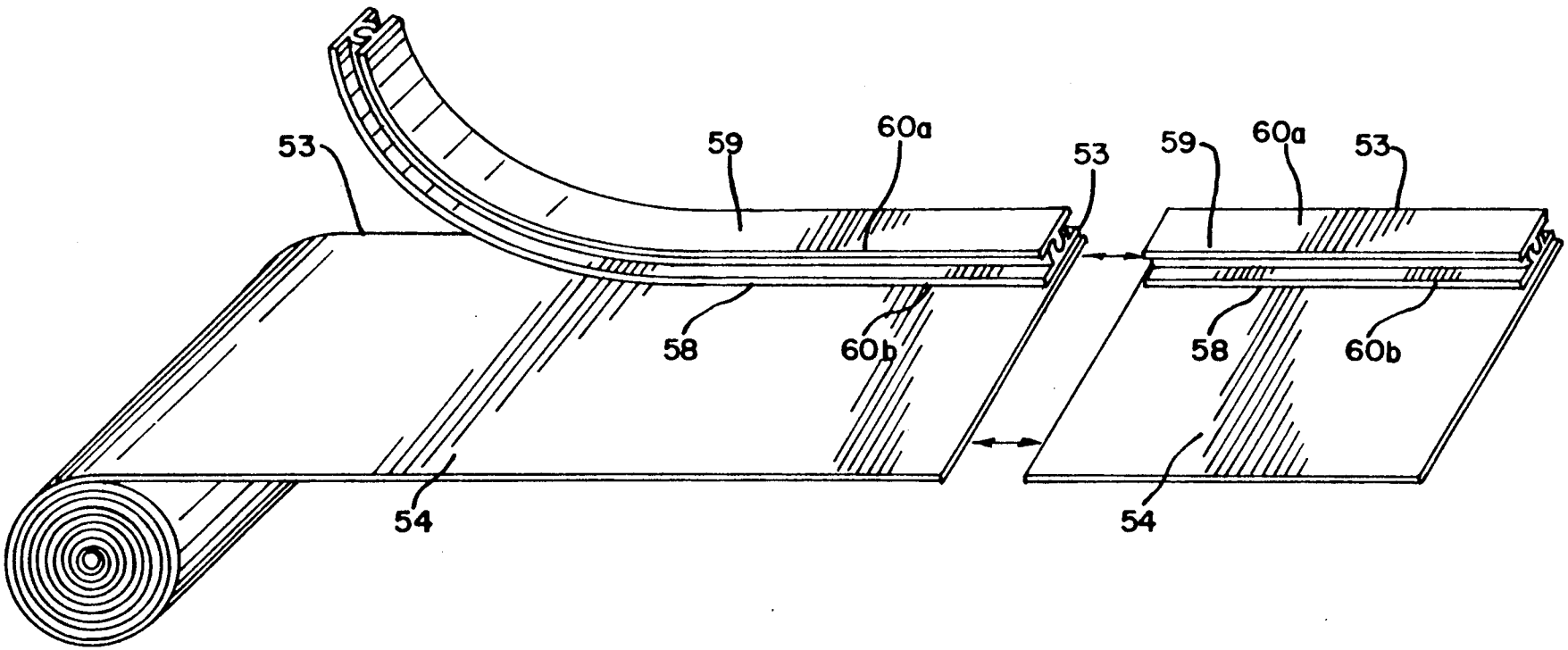
FIG. 4 is a view of one step of assembling packages of the present invention.

The assembly and filling of this package embodiment 50 is generally the same as for the embodiment illustrated in FIGS. 1 and 2. One of the interengaging fastener elements 58 is applied to an access edge 53 of the product backing board 54. Significantly and as shown best in FIG. 4, a continuous strip of the recloseable seal interengaged fastener elements 58, 59 may be fed and applied to the access edge 53 of a continuous length of the backing board 54. The continuous strip of interengaged fastener elements 58, 59 are preferably trimmed even with the edges of the backing board 54 and, accordingly, there is no wasting of the recloseable seal material. An individual backing board 54 may then be dimensioned and cut from the continuous length and transferred to a product application area. A preselected amount of luncheon meat 52 is then deposited on the backing board 54 to form a product-backing board assembly, which is subsequently transferred to a packaging station where first and second film sheets 64, 66 may be fed from supply rolls to opposite surfaces of the product-backing board assembly into contact with each other at a peripheral margin 62 extending around the product-backing board assembly. The first and second film sheets 64, 66 are adhered to the recloseable seal fastener element sealing flanges 60*a*, 60*b*, and the film sheets are bonded to each other at the peripheral margin 62 thereof to form the package hermetic seal.

When it is desired to open a finished package, the user grips the free edges of the first and second opposing film sheets and applies digital pull apart forces to open the peel seal portion 46 of the hermetic seal 44. The first and second film sheet portions in the area of the second peripheral margin 42 will separate down to the recloseable seal 26, because of the non-peelable nature of the remainder of the hermetic seal 44 which is not peripherally adjacent to the recloseable seal 26. Further exertion of digital forces will separate the recloseable seal 26, thereby allowing access to the package contents 12, and because the recloseable seal 26 is adhered to the backing board 18, the likelihood of destruction of the integrity of the package 10 is greatly diminished.

It will be seen that while certain embodiments of the present invention have been shown and described, it will be obvious to those skilled in the are that changes and modifications may be mace therein without departing from the true spirit of the scope of the invention.

I claim:

1. A method of enclosing a product deposited onto a product backing member between first and second sheets of packaging material, the method comprising the steps of:

attaching a fastener strip assembly of interengaging fastener elements to a product backing member adjacent to and generally parallel to an access edge of the product backing member, the interengaging fastener elements each having a package sealing flange disposed on opposite sides of the fastener strip, placing the product onto said product backing member in a manner such that the product does not contact the package sealing flanges of said fastener strip to form a product-backing assembly, placing the product-backing assembly between first and second sheets of flexible packaging material, attaching the first and second sheets of flexible packaging material to said fastener element package sealing flanges;

contacting said first and second sheets of flexible packaging material with each other at a hermetic seal area adjacent to said product-backing assembly and around the periphery of said product-backing assembly to create a hermetic seal which completely encloses said product-backing assembly between said first and second sheets of flexible packaging material, wherein said hermetic seal includes at least one peelable bond area adjacent to the access edge of said product-backing member.

2. The method of claim 1, wherein said interengaging fastener elements are adhered to said first and second sheets of flexible packaging material by adhesive means.

3. The method of claim 1, wherein one of said interengaging fastener elements of said fastener strip assembly is attached to the underside of said product backing member at said access edge of said product backing member.

4. The method of claim 1, wherein said interengaging fastener elements are adhered to said first and second sheets of flexible packaging material by heat sealing means.

5. The method of claim 1, wherein said interengaging fastener strip assembly includes interengaging rib and groove fastener elements.

6. The method of claim 1, further including the step of vacuum packing said product-backing assembly within said first and second sheets of flexible packaging material.

7. The method of claim 1, further including the step of attaching said interengaging fastener elements to said product backing member by adhering a longitudinal surface of one of said interengaging fastener elements to said product backing assembly along substantially the entire length of the access edge of said product backing member.

8. A method of enclosing a product and product board between a pair of films to provide a film package having a product enclosing portion and a recloseable seal portion, the first and second films being readily separable at the recloseable seal portion when access to the product is desired, the method comprising the steps of:

applying a continuous recloseable seal member adjacent and generally parallel to an access edge of a continuous product board, the recloseable seal member including a pair of interengaging fastener element, each element having a package sealing flange and one of said interengaging fastener elements having a product board flange, the continuous recloseable seal member being applied to the continuous product board along the product board flange of one of said interengaging fastener elements, separating an individual product board from said continuous product board, depositing product on said product board to form a product board assembly, enclosing the product board assembly between a first and second sheet of package film, drawing the first and second sheets of package film around the product board assembly to bring said first and second sheets of packaging film into contact with each other around the periphery of the product, bonding said first and second sheets of packaging film together around the periphery of the product, whereby a peelable hermetic bond is provided proximate to said product board access edge and a generally permanent hermetic bond is provided as to the remainder of the package.

* * * * *